US007870634B2

(12) United States Patent
Warning et al.

(10) Patent No.: US 7,870,634 B2
(45) Date of Patent: Jan. 18, 2011

(54) DUST MOP WITH MULTIPLE HANDLE HOLDERS

(76) Inventors: Brian D. Warning, 2 Deborah Dr., Bloomfield, IA (US) 52537; Margaret J. Warning, 2 Deborah Dr., Bloomfield, IA (US) 52537

( * ) Notice: Subject to any disclaimer, the term of this patent is extended or adjusted under 35 U.S.C. 154(b) by 360 days.

(21) Appl. No.: 12/219,293

(22) Filed: Jul. 18, 2008

(65) Prior Publication Data

US 2009/0025169 A1 Jan. 29, 2009

Related U.S. Application Data

(60) Provisional application No. 60/935,088, filed on Jul. 25, 2007.

(51) Int. Cl.
*A47L 13/252* (2006.01)

(52) U.S. Cl. ..... 15/229.8; 15/147.2; 15/144.1; 15/144.2; 15/145

(58) Field of Classification Search ..... 15/144.1, 15/144.2, 145, 147.1, 147.2, 228, 229.1–229.9
See application file for complete search history.

(56) References Cited

U.S. PATENT DOCUMENTS

| | | | | |
|---|---|---|---|---|
| 2,635,272 | A | 4/1953 | Johnson | |
| 2,967,320 | A | 1/1961 | Short | |
| 3,027,584 | A | 4/1962 | Bean | |
| 3,029,454 | A * | 4/1962 | Short et al. | 15/147.1 |
| 3,082,456 | A | 3/1963 | Short | |
| 3,440,677 | A * | 4/1969 | Flomerfelt | 15/144.1 |
| 4,766,632 | A * | 8/1988 | Murray | 15/147.1 |
| 4,800,609 | A | 1/1989 | Peck | |
| 5,398,492 | A | 3/1995 | Thomas | |
| 5,452,491 | A | 9/1995 | Thompson | |
| 5,680,667 | A | 10/1997 | Kresse et al. | |
| 6,237,182 | B1 | 5/2001 | Cassar | |
| 6,308,366 | B1 | 10/2001 | Hays | |
| 2005/0229350 | A1 | 10/2005 | Lee | |

FOREIGN PATENT DOCUMENTS

| | | |
|---|---|---|
| DE | 3808310 | 9/1989 |

* cited by examiner

*Primary Examiner*—Mark Spisich
(74) *Attorney, Agent, or Firm*—Richard C. Litman

(57) ABSTRACT

The dust mop with multiple handle holders is a dust mop having a handle, a dust mop frame, and a dust mop head. The frame has multiple handle holders, including a central handle holder in the center of the fame and another handle holder at one or both ends of the frame so that the handle can be attached to the central handle holder for general use, and may optionally be attached to a handle holder at the end of the frame to dust under objects raised above the floor and in areas too narrow to accommodate a conventional dust mop. The dust mop head is a fabric cover supported on the frame, and has an opening through which the handle can be connected to the handle holders. The handle may have a quick connect, clip-type fitting at one end for attachment to the handle holder.

20 Claims, 9 Drawing Sheets

DUST MOP WITH MULTIPLE HANDLE HOLDERS

CROSS-REFERENCE TO RELATED APPLICATION

This application claims the benefit of U.S. Provisional Patent Application Ser. No. 60/935,088, filed Jul. 25, 2007.

BACKGROUND OF THE INVENTION

1. Field of the Invention

The present invention relates generally to dust mops, and more specifically relates to a dust mop with multiple handle holders to allow attachment of the handle to a central portion of the dust mop frame for normal use, or to an end of the dust mop frame for use in tight quarters.

2. Description of the Related Art

It is difficult to use a conventional dust mop to dust the floor below an article of furniture, such as, for example, a chair, a table, a sofa, retail shelving with no kick plate, produce carts, clothes racks or the like. Since the handle is usually connected to the center of the dust mop head, often only half of the dust mop can be used. Some places are difficult to reach, and some places, such as under grocery shelves, for example, cannot be reached with an ordinary dust mop, particularly when the user has an infirmity or injury, such as a bad back or knee problem, that prevents bending over or crouching down. Further, some exposed areas of floor typically form a narrow strip or corridor, such as between two heavy or fixed objects, and if the objects are difficult to move, the objects may be so closely spaced together that the dust mop head is too wide to fit between the objects.

There is a need for a dust mop that can be used to dust under objects raised above the floor and, further, in areas too narrow to accommodate a conventional dust mop. Thus, a dust mop with multiple handle holders solving the aforementioned problems is desired.

SUMMARY OF THE INVENTION

The dust mop with multiple handle holders is a dust mop having a handle, a dust mop frame, and a dust mop head. The frame has multiple handle holders, including a central handle holder in the center of the fame and another handle holder at one or both ends of the frame so that the handle can be attached to the central handle holder for general use. The handle may optionally be attached to a handle holder at the end of the frame to dust under objects raised above the floor and in areas too narrow to accommodate a conventional dust mop. The dust mop head is a fabric cover supported on the frame, and has an opening through which the handle can be connected to the handle holders. The handle may have a quick connect, clip-type fitting at one end for attachment to the handle holder.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
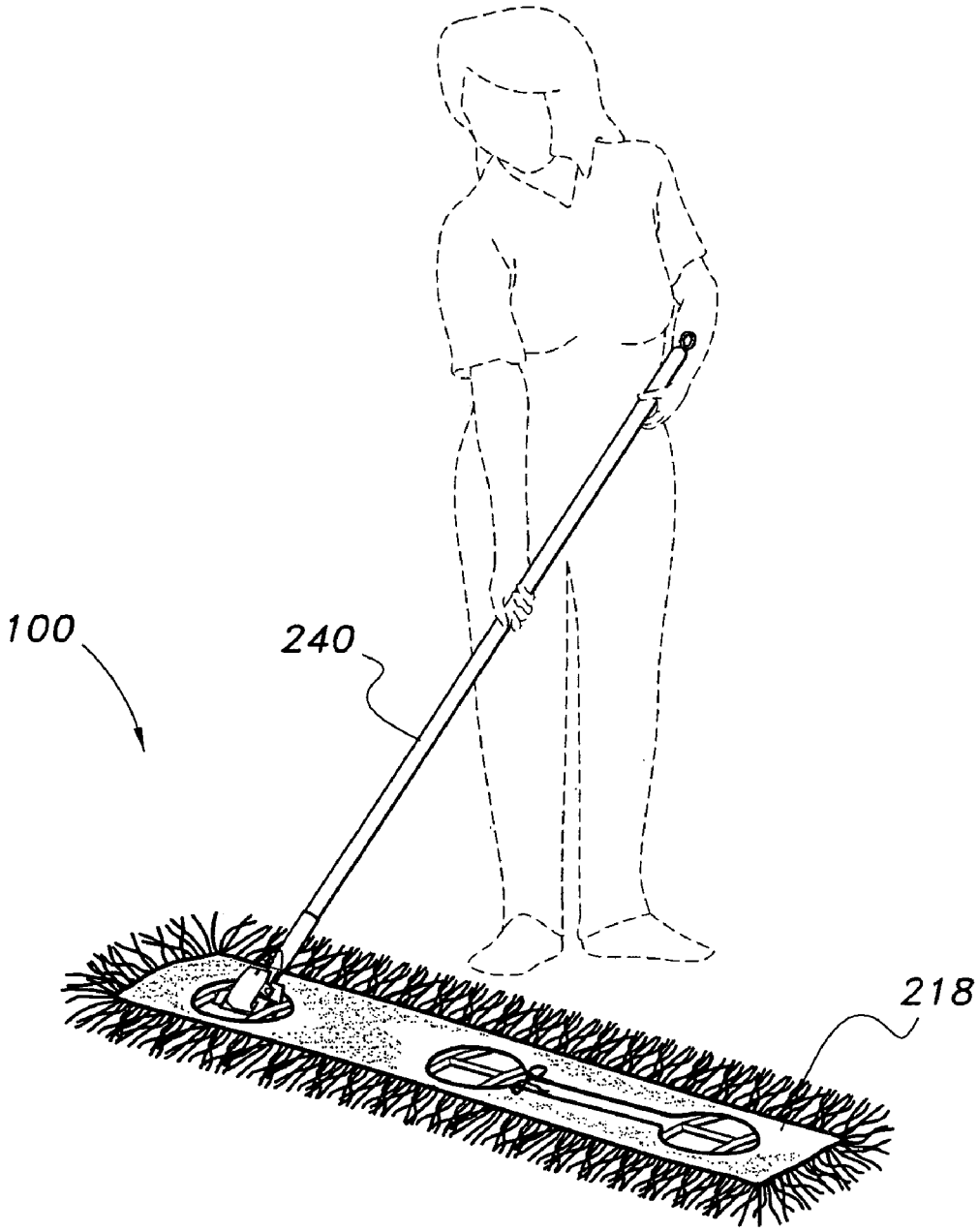
FIG. 1 is an environmental, perspective view of a dust mop with multiple handle holders according to the present invention.

The present invention relates to a dust mop with multiple handle holders, designated generally as 100 in the drawings. The dust mop 100 includes a handle 240, an elongated dust mop frame 200, and a dust mop head or cover 218. As will described in greater detail below, the frame 200 has multiple handle holders, including a central handle holder in the center of the frame 200 and another handle holder at one or both ends of the frame 200, permitting the handle 240 to be attached to the central handle holder for general use, or to one of the end handle holders (as shown in FIG. 1) for dusting under objects raised above the floor, such as furniture, shelves, etc.

Figure 2A:
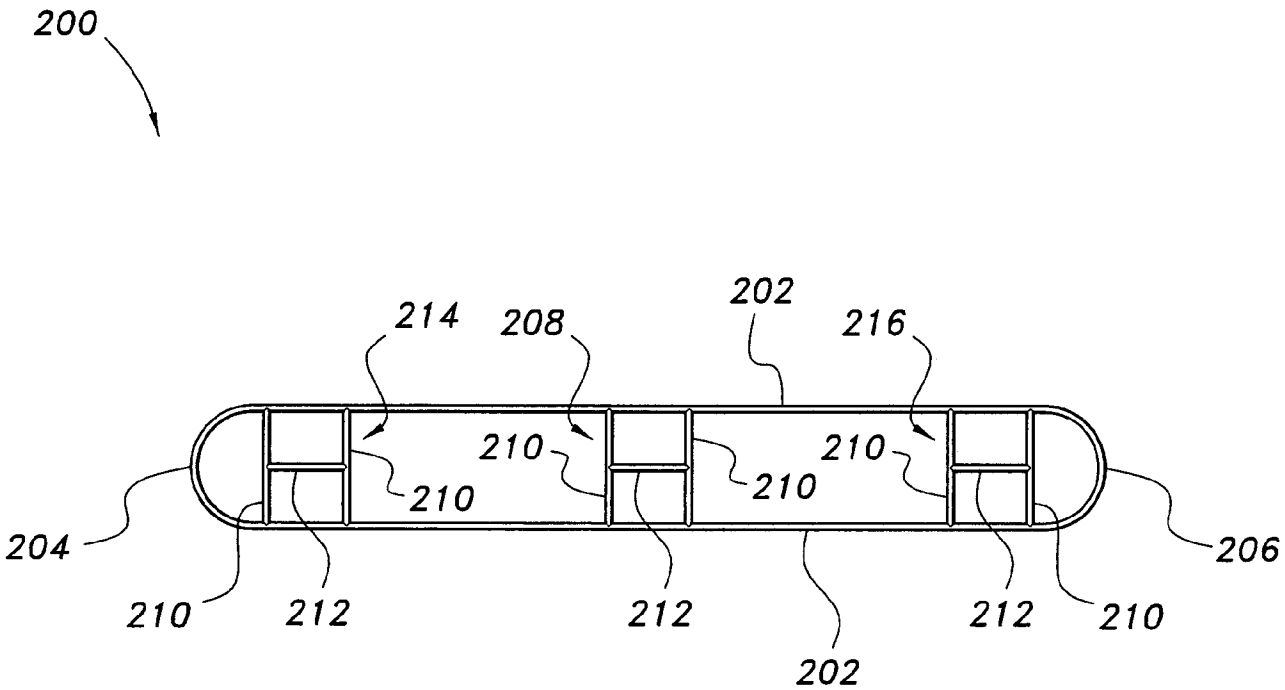
FIG. 2A is a plan view of a dust mop frame for a dust mop with multiple handle holders according to the present invention.

Referring to FIG. 2A, the dust mop frame 200 is made from tubes or rods, and has a generally elongated rectangular or oblong shape formed by elongated longitudinal side members 202 and rounded opposing end members 204 and 206. The frame 200 has a central handle holder 208 formed by parallel crossmembers 210 and a transverse bar 212, which extends parallel to longitudinal side members 202. The frame shown in FIG. 2A includes two end handle holders 214 and 216 formed in the same manner as central handle holder 208, with handle holder 214 being adjacent end member 204 and handle holder 216 being adjacent end member 206.

It will be understood that the dual holders of frame 200 are shown for illustrative purposes only, and that frame 200 may have only a single end handle holder 214 or 216. Further, it will be understood that the handle holders 208, 214 and 216 may have any suitable structure, configuration, or orientation for receiving a pole handle of the type typically used with dust mops, there being a great many configurations of connectors disposed on the ends of dust mop handles for attachment to dust mop frames, with the handle holders 208, 214, and 216 being configured accordingly.

Figure 2B:
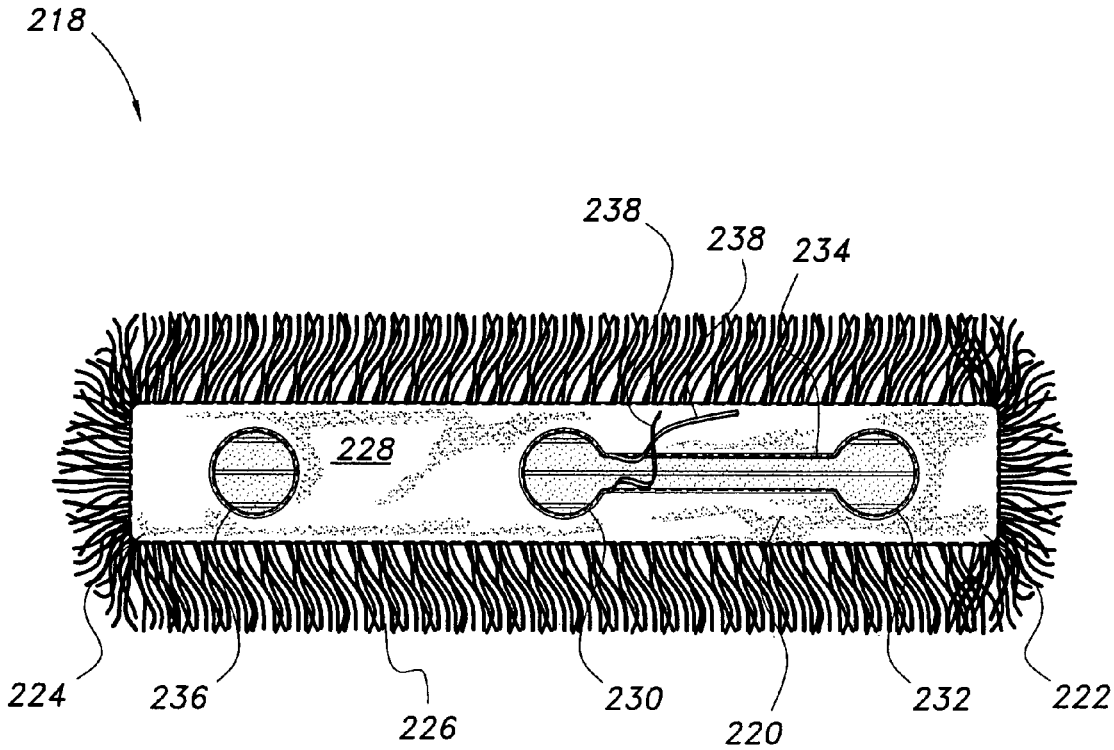
FIG. 2B is a plan view of a dust mop cover for a dust mop with multiple handle holders according to the present invention.

As shown in FIG. 2B, the dust mop head or cover 218 is provided in the form of an elongated rectangular or oblong fabric sleeve 220 having a first end 222, a second end 224, and yarn tentacles or filaments 226 extending from the periphery of the sleeve 220 for collecting dust. The sleeve 220 defines a hollow interior for receiving the frame 200 and has a top layer 228 of fabric defining a central aperture 230 and a second aperture 232 adjacent the first end 222 of the sleeve 220. An elongated slot 234 connects the central aperture 230 and the second aperture 232, providing a means for insertion of the frame 200 within the sleeve 220. The cover 218 may have a third aperture 236 adjacent the second end 224 of the sleeve 220 when the frame 200 has second end handle holder 214.

Each handle holder 208, 214, and 216 on the frame 200 is aligned with a respective aperture 230, 236, and 232, respectively, when the frame 200 is within the sleeve 220. A pair of ribbons or the like 238 are provided on the sleeve 220 for closing the central aperture 230 and securing the frame 200 within the sleeve 220.

Figure 3:
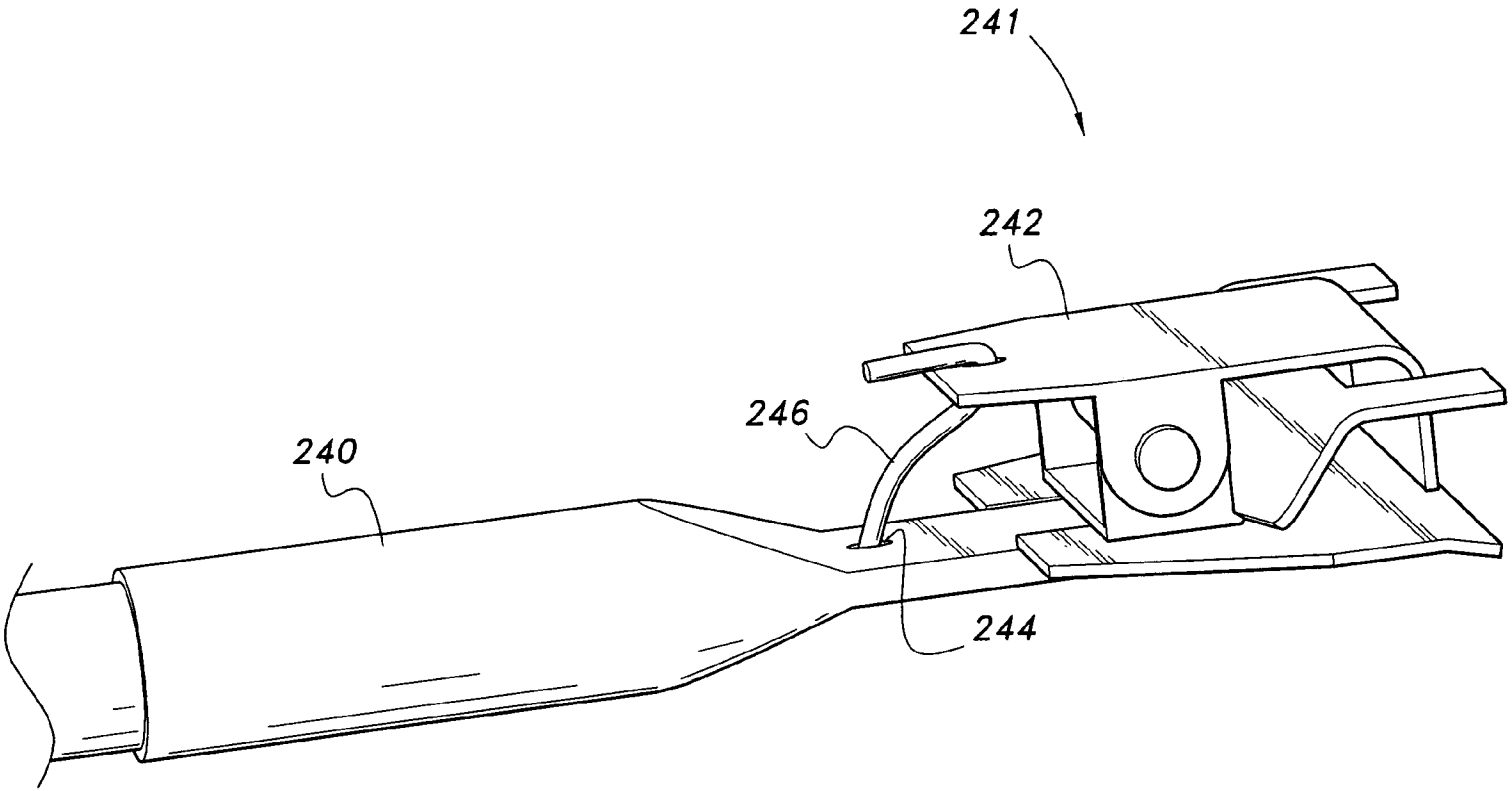
FIG. 3 is a perspective view of the lower end of a handle for a dust mop with multiple handle holders according to the present invention.
Figure 4:
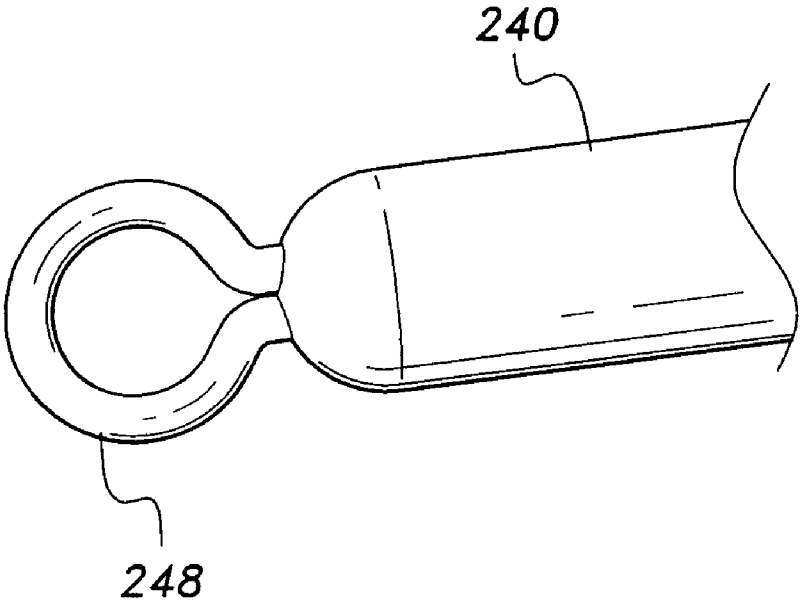
FIG. 4 is a perspective view of the upper end of a mop handle for a dust mop with multiple handle holders according to the present invention.
Figure 5:
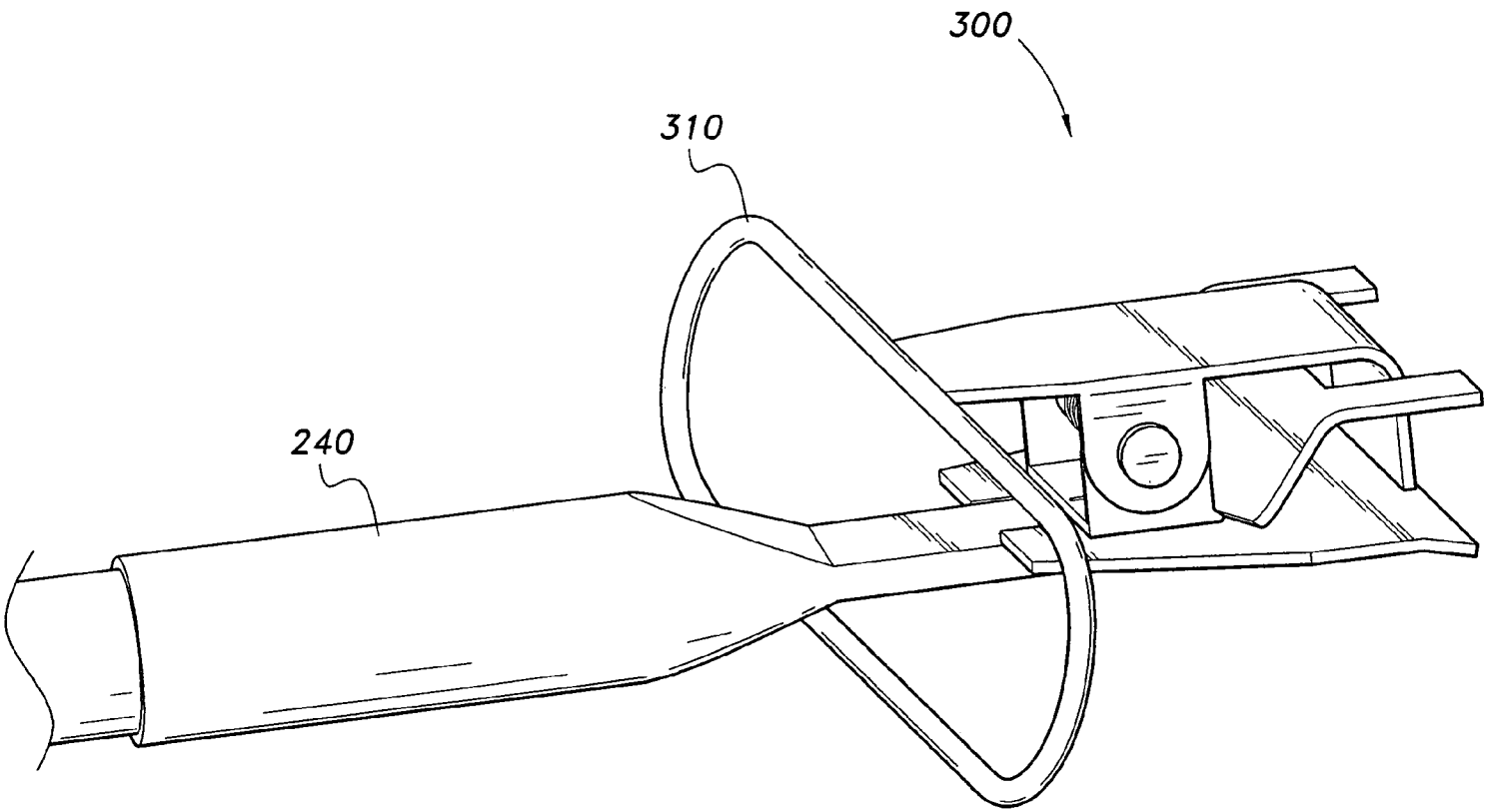
FIG. 5 is a perspective view of an alternative embodiment of the lower end of the handle for a dust mop with multiple handle holders according to the present invention.

As best seen in FIGS. 3 and 4, mop handle 240 is an elongated pole handle having a connector 241 at one end adapted for attaching the handle 240 to the frame 200. The connector 241 may be any connector or other fitting adapted for attachment to the handle holders 208, 214 and 216, and may provide for pivoting of the handle 240, swiveling or rotating the handle 240, or other manipulation of the handle 240 to facilitate use of the dust mop 100. FIG. 3 shows a preferred embodiment of a connector 241 having a quick-connect spring-biased clamp 242 for securing the handle 240 to the handle holders 208, 214, and 216. The handle 240 is hollow and has an aperture 244 near the bottom end adjacent to the clamp 242. A cable or wire 246 is attached to the clamp 242 and passes through the handle aperture 244 to the top of the handle 240 where the wire 246 is secured to an eyebolt 248, shown in FIG. 4. Pulling on the eyebolt 248 opens the clamp 242 so that the handle 240 can be removed from or reattached to the handle holders 208, 214, 216.

When a mop handle 240 is connected through the central aperture 230 of the dust mop cover 218 to the central handle holder 208, the mop 100 can be used in a normal fashion for dusting. When the mop handle 240 is connected through the second 232 or third 236 apertures to the second 216 or third 214 handle holder, respectively, the mop 100 is configured for dusting hard to reach places. Depending upon the type of connector 241 at the end of the handle 240, the handle 240 may pivot normal to the frame 200, as shown in FIG. 1, or may be rotated or swiveled and then pivoted parallel to longitudinal sides 202 so that the frame 200 and dust mop cover 218 can be pushed endwise to reach otherwise inaccessible locations.

Figure 6:
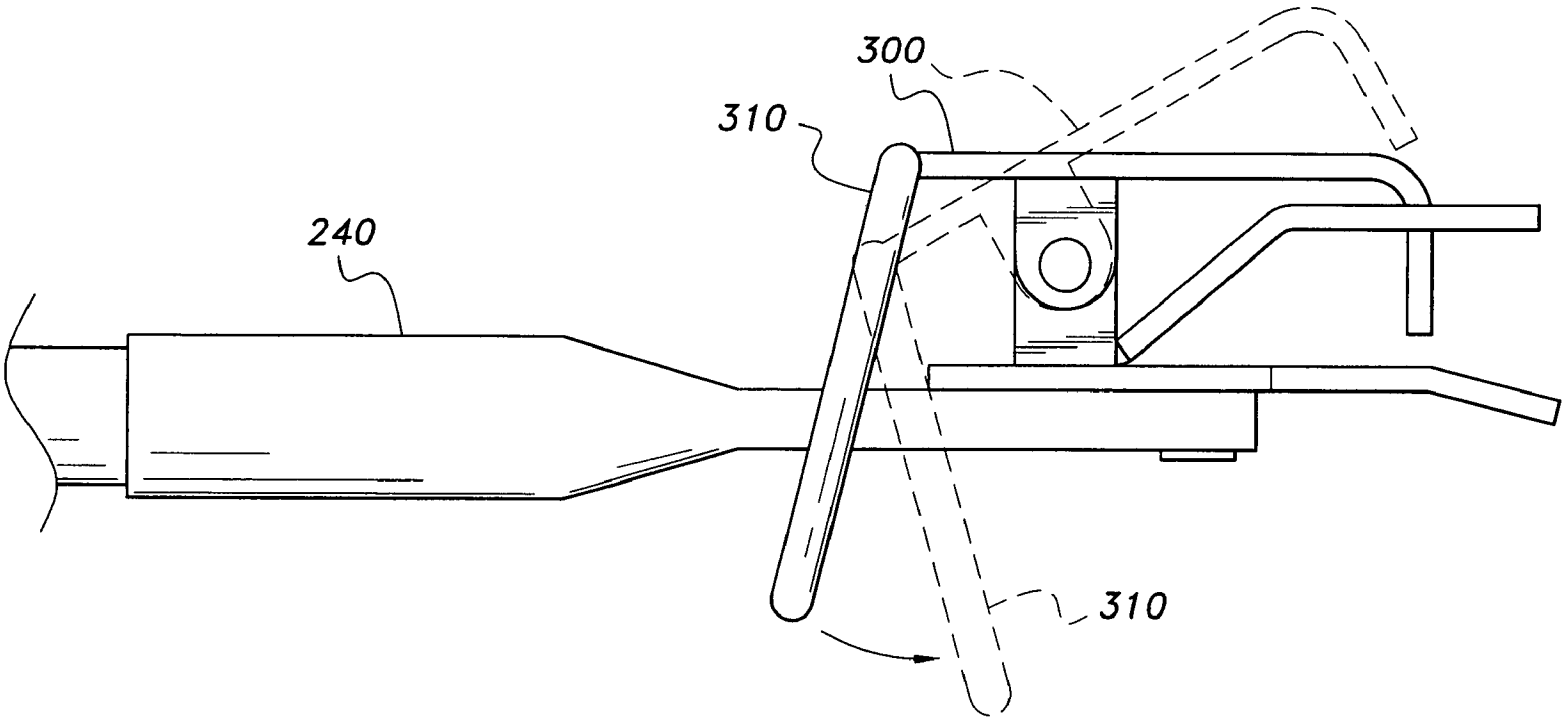
FIG. 6 is a side view of the lower end of the handle for a dust mop of FIG. 5.
Figure 7:
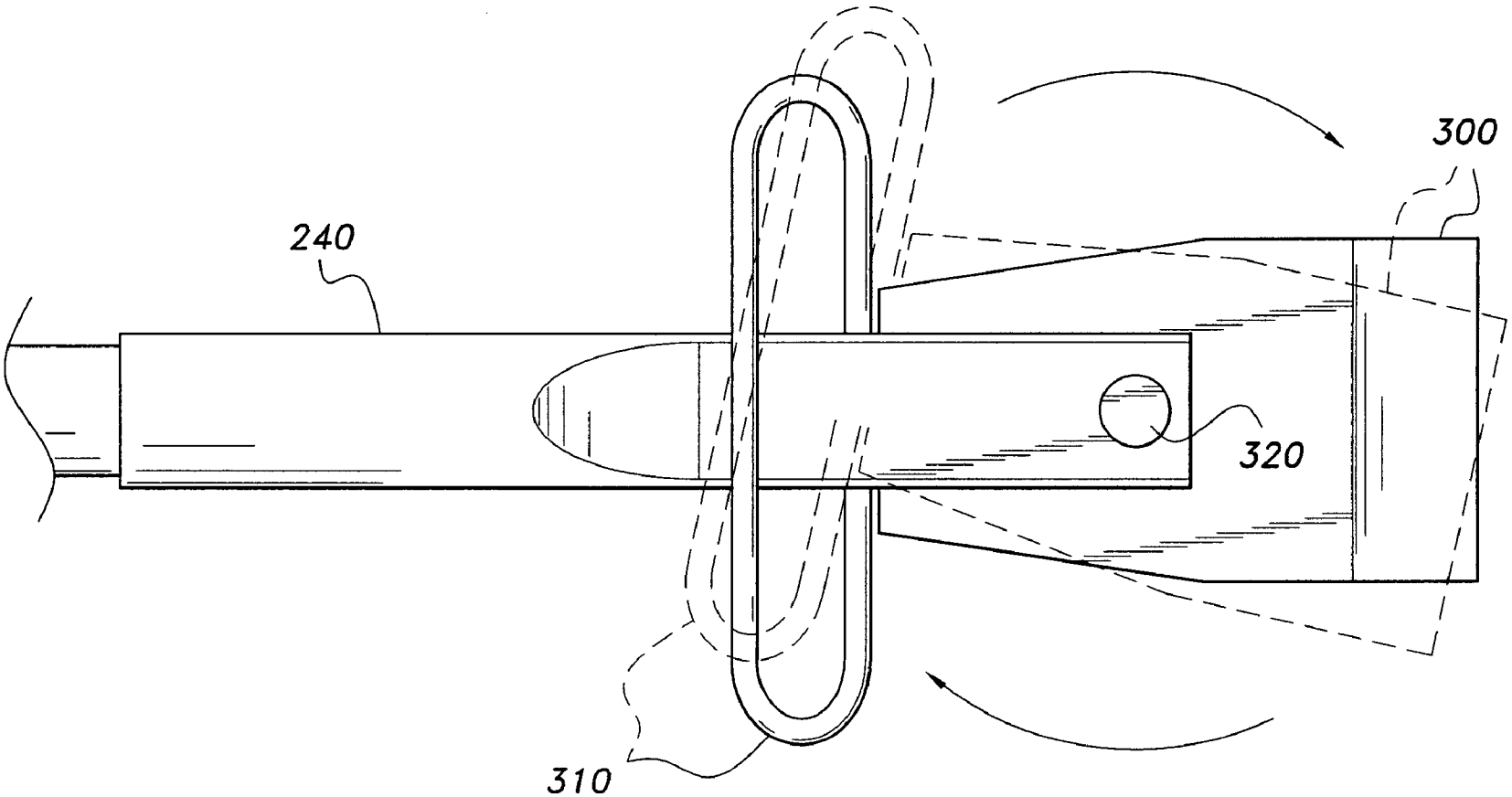
FIG. 7 is a bottom view of the lower end of the handle for a dust mop of FIG. 5.
Figure 8:
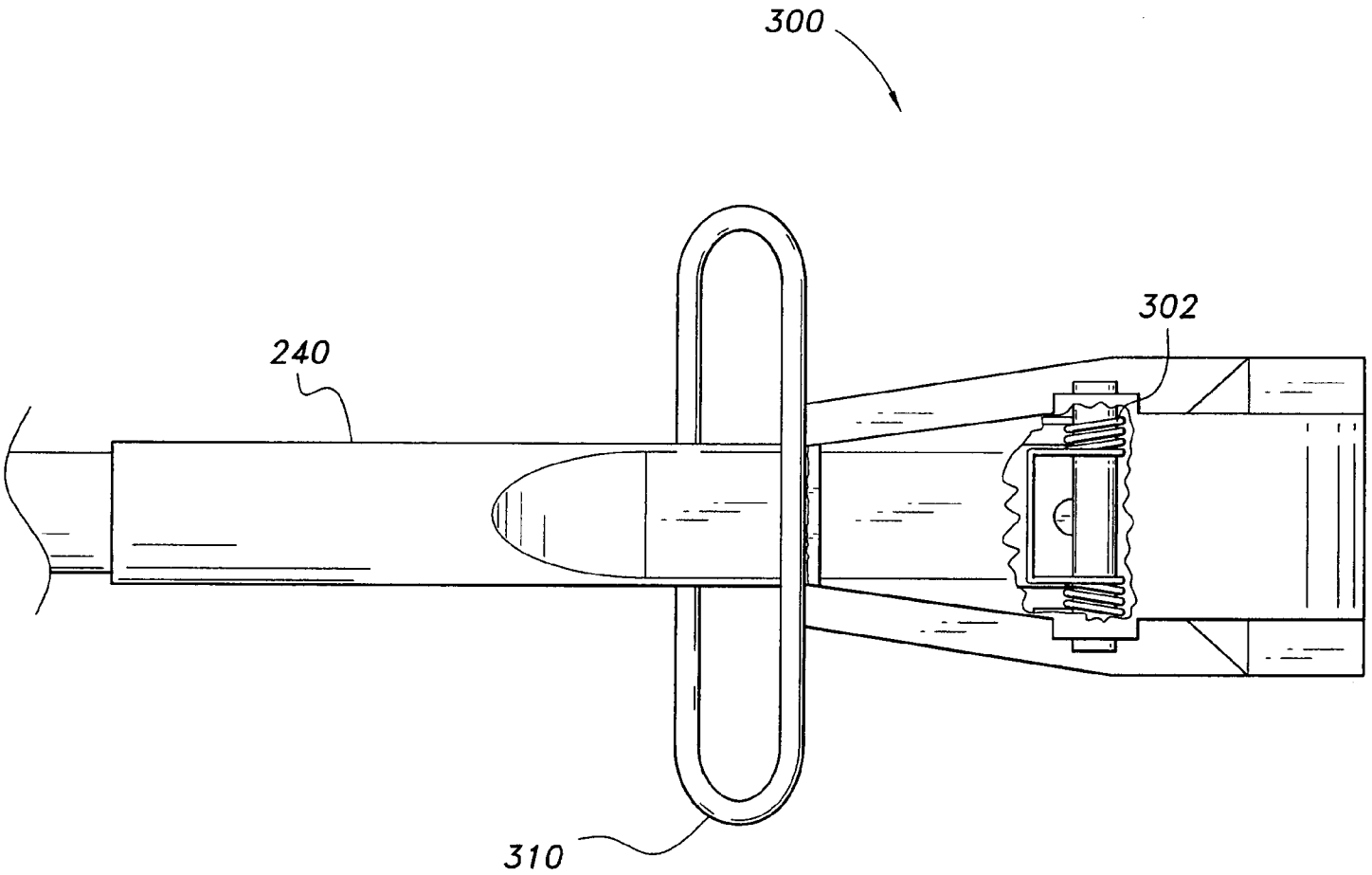
FIG. 8 is a top view of the lower end of the handle for a dust mop of FIG. 5.

In the alternative embodiment of FIGS. 5-8, connector 241 is replaced by a clamp 300, which may be a spring-biased clamp, as shown, or any other suitable clamping connector. The clamp 300 includes a latch plate connected to a bearing plate by a pivot pin. The latch plate is biased to a normally closed position by a torsion spring 302 having coils concentrically mounted on the pivot pin, the coils being connected by a tongue that bears against the latch plate. It should be understood that torsion spring 302 of FIG. 8 is shown for exemplary purposes only, and that any suitable spring-biased element may be utilized. The clamp 300 is selectively opened through rotation of pedal 310, which is preferably configured to be operated by the user's foot. Pedal 310 is fixed to the latch plate and loops around a mounting ferrule at the end of the mop handle 240. Thus, rather than pulling on cable 246 of the embodiment of FIG. 3, the user may selectively open clamp 300 by pushing the user's foot against pedal 310 (as illustrated in FIG. 6). Further, the clamp 300 may be pivotally joined to the handle 240, as shown in FIG. 7, through a pivot pin 320 or the like extending through the ferrule, allowing for rotating movement about the lower end of the handle 240. This allows the mop head to be used in spaces where the head must be angled with respect to the handle 240.

It is to be understood that the present invention is not limited to the embodiment described above, but encompasses any and all embodiments within the scope of the following claims.

We claim:

1. A dust mop with multiple handle holders, comprising:

an elongated dust mop frame having opposing ends, a central handle holder disposed midway between the opposing ends, and at least one end handle holder disposed adjacent one of the opposing ends of the frame;

a dust mop cover having a fabric sleeve removably disposed on the dust mop frame, the sleeve having a top layer having a central aperture defined therethrough aligned with the central handle holder, a second aperture defined therethrough aligned with the at least one end handle holder, and a slot extending between the central aperture and the second aperture, the slot being dimensioned and configured for inserting the frame into the sleeve, the cover having a plurality of fabric filaments extending from a periphery of the sleeve for collecting dust; and an elongated pole handle having a connector at one end thereof, the connector alternately releasably engaging the central handle holder and the at least one end handle holder in order to alternately push the dust mop from the center of the frame and one of the ends of the frame.

2. The dust mop as recited in claim 1, wherein the at least one end handle holder comprises a pair of end handle holders positioned adjacent the opposing ends of the frame, respectively.

3. The dust mop as recited in claim 2, wherein said dust mop cover has a third aperture defined therethrough, said second and third apertures being respectively aligned with the pair of end handle holders.

4. The dust mop as recited in claim 1, wherein said connector comprises a spring-biased clamp.

5. The dust mop as recited in claim 4, further comprising a cable having opposed first and second ends, the first end thereof being attached to said connector, the second end thereof being positioned adjacent an opposite end of said elongated pole handle, whereby the user may pull the second end of said cable to selectively open said clamp.

6. The dust mop as recited in claim 4, further comprising a pedal secured to said connector, whereby the user may selectively depress said pedal to selectively open said clamp.

7. The dust mop as recited in claim 6, wherein said clamp is pivotally attached to the elongated pole handle.

8. A dust mop with multiple handle holders, comprising:

an elongated dust mop frame having opposing ends;

a dust mop cover having a fabric sleeve removably disposed on the dust mop frame and a plurality of fabric filaments extending from a periphery of the sleeve for collecting dust;

an elongated pole handle having a connector at one end thereof; and means for alternately attaching the pole handle to a central portion of the frame between the opposing ends for general use or to one of the opposing ends of the frame for dusting under an object raised above a floor and other restricted access areas by pushing the dust mop from one of the ends of the frame.

9. The dust mop as recited in claim 8, wherein the elongated dust mop frame further comprises a central handle holder disposed midway between the opposing ends and at least one end handle holder disposed adjacent one of the opposing ends of the frame.

10. The dust mop as recited in claim 9, wherein the sleeve of the dust mop cover has a top layer having a central aperture defined therethrough aligned with the central handle holder, a second aperture defined therethrough aligned with the at least one end handle holder, and a slot extending between the central aperture and the second aperture, the slot being dimensioned and configured for inserting the frame into the sleeve.

11. The dust mop as recited in claim 10, wherein the at least one end handle holder comprises a pair of end handle holders, each said end handle holder being positioned adjacent a respective one of the opposing ends of the frame.

12. The dust mop as recited in claim 11, wherein said dust mop cover has a third aperture defined therethrough, said second and third apertures being respectively aligned with the pair of end handle holders.

13. The dust mop as recited in claim 10, wherein said connector comprises a spring-biased clamp.

14. The dust mop as recited in claim 13, further comprising a cable having opposed first and second ends, the first end thereof being attached to said connector, the second end thereof being positioned adjacent an opposite end of said elongated pole handle, whereby the user may pull the second end of said cable to selectively open said clamp.

15. The dust mop as recited in claim 13, further comprising a pedal attached to said connector, whereby the user may selectively depress said pedal to selectively open said clamp.

16. The dust mop as recited in claim 15, wherein said clamp is pivotally secured to the elongated pole handle.

17. A dust mop with multiple handle holders, comprising:

an elongated dust mop frame having opposing ends, a central handle holder disposed midway between the opposing ends, and at least one end handle holder disposed adjacent one of the opposing ends of the frame;

a dust mop cover having a fabric sleeve removably disposed on the dust mop frame and a plurality of fabric filaments extending from a periphery of the sleeve for collecting dust; and an elongated pole handle having a quick connect fitting at one end thereof, the fitting alternately releasably engaging the central handle holder and the at least one end handle holder in order to alternately push the dust mop from the center of the frame and one of the ends of the frame, the fitting being operable from the end of the pole handle opposite the quick connect fitting.

18. The dust mop as recited in claim 17, wherein the at least one end handle holder comprises a pair of end handle holders positioned adjacent the opposing ends of the frame, respectively.

19. The dust mop as recited in claim 18, wherein the sleeve of the dust mop cover has a top layer having a central aperture defined therethrough aligned with the central handle holder, a second aperture defined therethrough aligned with the at least one end handle holder, and a slot extending between the central aperture and the second aperture, the slot being dimensioned and configured for inserting the frame into the sleeve.

20. The dust mop with multiple handle holders as recited in claim 19, wherein said dust mop cover has a third aperture defined therethrough, said second and third apertures being respectively aligned with the pair of end handle holders.

* * * * *